US005617838A

United States Patent [19]

Peruski

[11] Patent Number: 5,617,838

[45] Date of Patent: Apr. 8, 1997

[54] ARCHERY AID

[76] Inventor: Robert H. Peruski, 2254 Main St., Ubly, Mich. 48475

[21] Appl. No.: 421,230

[22] Filed: Apr. 13, 1995

[51] Int. Cl.[6] ..... F41B 5/14

[52] U.S. Cl. ..... 124/88

[58] Field of Search ..... 124/23.1, 86, 88, 124/87

[56] References Cited

U.S. PATENT DOCUMENTS

| | | | |
|---|---|---|---|
| 2,370,783 | 3/1945 | Dritz . | |
| 3,103,213 | 9/1960 | Robinson . | |
| 3,176,674 | 4/1965 | Smith | 124/23.1 |
| 3,572,312 | 3/1971 | Foster . | |
| 3,599,621 | 8/1971 | Scrobell . | |
| 3,762,401 | 10/1973 | Tupper . | |
| 4,457,287 | 7/1984 | Babington . | |
| 4,625,420 | 12/1986 | Figured | 124/87 X |
| 4,777,666 | 10/1988 | Beverlin | 124/88 X |
| 4,787,361 | 11/1988 | Vyprachticky | 124/88 |
| 4,996,968 | 3/1991 | Hollingsworth | 124/88 X |
| 5,070,856 | 12/1991 | Plummer | 124/23.1 X |
| 5,113,841 | 5/1992 | Bratcher | 124/23.1 |
| 5,333,595 | 8/1994 | Heffron | 124/88 |
| 5,349,937 | 9/1994 | Burling | 124/86 X |

*Primary Examiner*—John A. Ricci
*Attorney, Agent, or Firm*—John J. Swartz

[57] ABSTRACT

An archery aid for improving shooting accuracy of an arrow propelled by an archery bow having a taut bow string spanning opposite ends of the bow. The archery aid includes a plate mounted on the bow adjacent the hand rest against which a forward archer's bow hand bears when the bow is being drawn. The plate extends in the path of the fingers of the archer's bow hand to prevent the fingers from gripping the bow during and after string and arrow release. A finger receiving member is mounted on the plate for detachably securing the fingers to the plate.

51 Claims, 7 Drawing Sheets

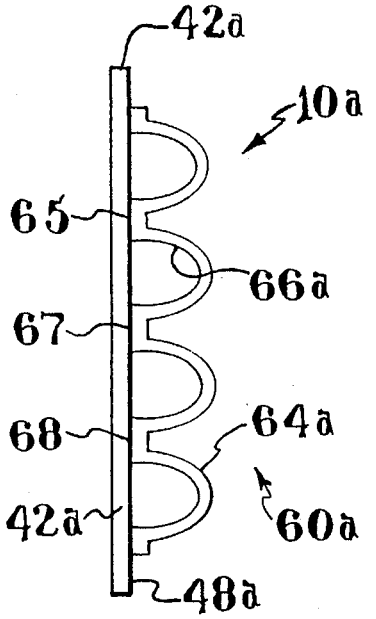
Fig. 7
Fig. 8
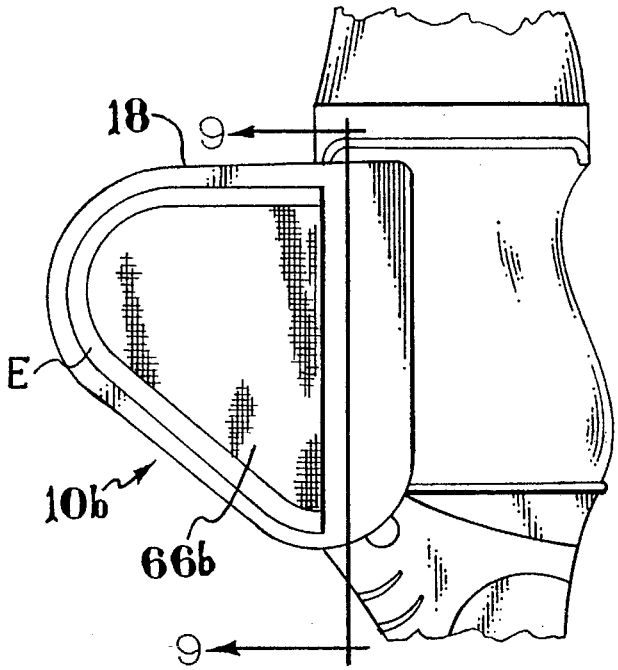
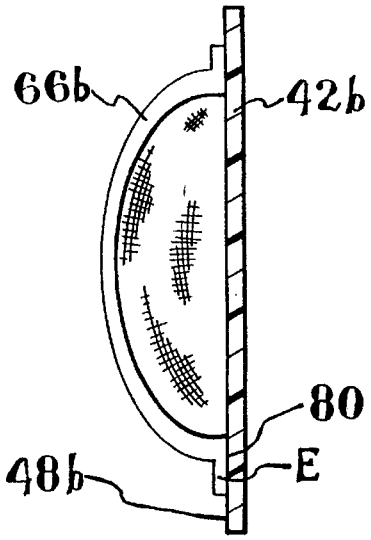
Fig. 9
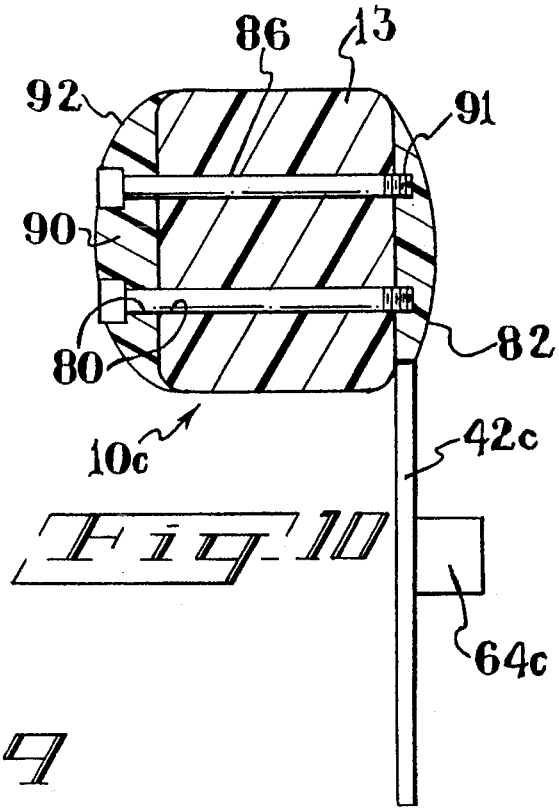
Fig. 10

ARCHERY AID

BACKGROUND OF THE INVENTION

1. Field of the Invention

This invention relates to an archery aid for improving shooting accuracy of an arrow and more particularly to apparatus for precluding an archer's bow holding hand from gripping the bow.

2. Description of the Prior Art and Objects

It is generally understood that during arrow release, an archer should not close his hand to grip an archery bow as such gripping tends to cause a "jerk" which results in an errantly shot arrow. This problem was appreciated, for example, in U.S. Pat. No. 4,777,666 issued to William C. Beverlin on Oct. 18, 1988. During arrow release, archers are not to close the fingers of the bow holding hand around the bow but rather the archer should keep an "open bow holding hand". One problem which is occasioned by keeping the bow holding hand open, however, is that the bow will drop after the bow string is released.

To preclude the bow from dropping, a bow sling, which couples the bow to the archer's wrist, has been provided such as that disclosed in the aforementioned U.S. Pat. No. 4,777,666; U.S. Pat. No. 3,103,213 issued to A. E. Robinson on Sep. 10, 1963; and U.S. Pat. No. 3,572,312 issued to M. L. Foster on Mar. 23, 1971. The prior bow sling has not proved entirely satisfactory in that the bow sling sometimes tends to slip off the wrist of the bow holding hand. Moreover, even though a sling is provided, the natural tendency of the archer still is to grip the bow after arrow release. Unfortunately, the archer will anticipate arrow release and will tend to flinch and grip the bow prior to arrow release, so that the bow does not fall, and thus, shooting inaccuracy results. Accordingly, it is an object of the present invention to provide an archery aid for maintaining open the bow holding hand during and after arrow release.

It is another object of the present invention to provide a new and novel archery aid for improving shooting accuracy.

It is yet another object of the present invention to provide new and novel apparatus for precluding an archer's bow hand from gripping the outside front face of an archer's bow.

A further object of the present invention is to provide a new and novel archery aid for maintaining the fingers of an archer's bow support hand pointed forwardly in a direction toward the target.

It is a still further object of the present invention to provide a new and novel archery aid for maintaining the fingers of the bow support hand pointed forwardly in a direction parallel to a direction of an arrow to be propelled by the bow.

It is a still another object of the present invention to provide a new and novel archery aid which will relax the archer by insuring that the archer's bow holding hand will support, but not grip the bow throughout the arrow release.

It is another object of the present invention to provide a new and novel archery aid which will allow an archer to repeatedly and consistently hold an archery bow.

It has also been found that upon arrow release, the natural tendency of the bow is to rotate about a vertical axis in a direction transverse to the open palm of the bow hand. If this rotation occurs, the arrow will tend to be deflected. Handles have been pivotally mounted on a bow, such as that illustrated in U.S. Pat. No. 3,599,621 issued to Delvin A. Screbell on Aug. 17, 1971 and U.S. Pat. No. 4,457,287 issued to Charles E. Babington on Jul. 3, 1994, however, neither of these handles precludes the bow from turning about a vertical axis. Accordingly, it is an object of the present invention to provide a new and novel archery aid which will inhibit bow rotation about its vertical axis bow upon arrow release.

It is another object of the present invention to provide a stop plate which is mounted on a mid-portion of a bow adjacent a hand grip so as to be in the path of the fingers of a bow holding hand to preclude the fingers from gripping the bow.

Another object of the present invention is to provide a plate mounted on a mid-portion of a bow in the path of the fingers of a bow holding hand so that the fingers will exert force on the plate in a direction opposite the direction which the bow tends to rotate after arrow release.

Yet another object of the present invention is to provide an archery aid of the type described including mechanism for detachably securing at least one of the fingers on the archer's bow holding hand to the archery aid.

Still another object of the present invention is to provide an archery aid of the type described wherein the mechanism for securing the finger comprises a band.

Another object of the present invention is to provide an archery aid of the type described wherein the apparatus for securing the fingers comprise a glove.

Yet another object of the present invention is to provide an archery aid of the type described wherein the apparatus for securing the fingers comprises apparatus for detachably coupling a finger receiving glove to a stop plate mounted on the side of an archery bow.

A still further object of the present invention is to provide an archery aid of the type described wherein the band is adjustable.

Another object of the present invention is to provide an archery aid of the type described including a sling for holding the wrist of the bow shooter's hand and preventing the wrist from swinging outwardly away from the bow.

Other objects and advantages of the present invention will become apparent to those of ordinary skill in the art as the description thereof proceeds.

SUMMARY OF THE INVENTION

An archery aid for an archery bow having a front outside surface, and a rear inside surface against which the open palm of an archer's bow hand bears, the archery aid comprising: a member, adapted to be mounted on the bow in the path of the fingers of the archer's bow hand, for precluding the fingers from closing and gripping the front outside surface of the bow. A sling tautly couples the wrist of the shooter's bow hand to the bow.

DESCRIPTION OF THE DRAWINGS

The invention may be more readily understood by referring to the accompanying drawings, in which:

FIG. 7 is a front elevational view similar to FIG. 3, of a slightly modified embodiment;

FIG. 8 is a side elevational view of another slightly modified embodiment;

FIG. 9 is a rear sectional view, taken along the line 9—9 of FIG. 8;

FIG. 10 is a sectional view illustrating still another slightly modified invention;

DESCRIPTION OF THE PREFERRED EMBODIMENT

Figure 1:
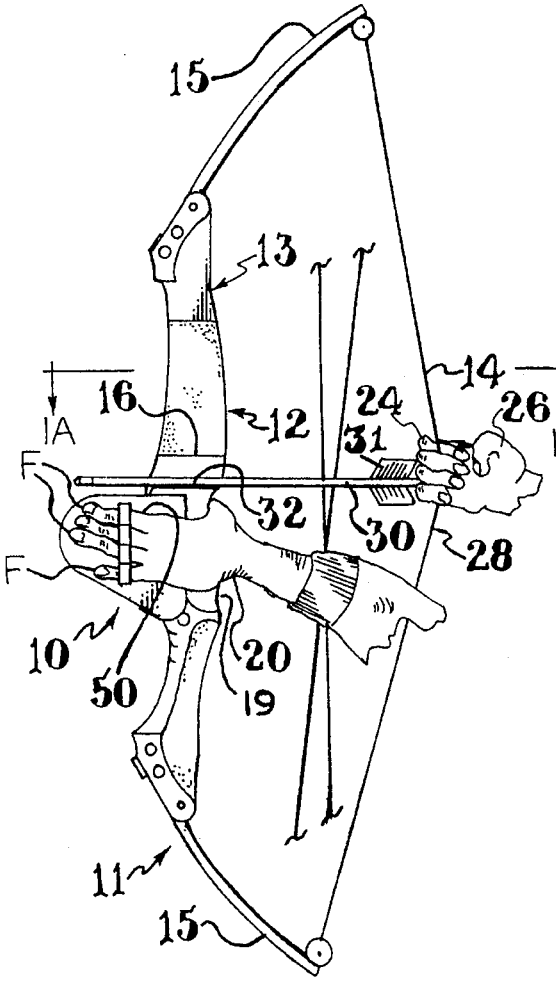
FIG. 1 is a side elevational view illustrating an archery bow which mounts an archery aid constructed according to the present invention for accurately propelling an arrow which rests on the bow.
Figure 2:
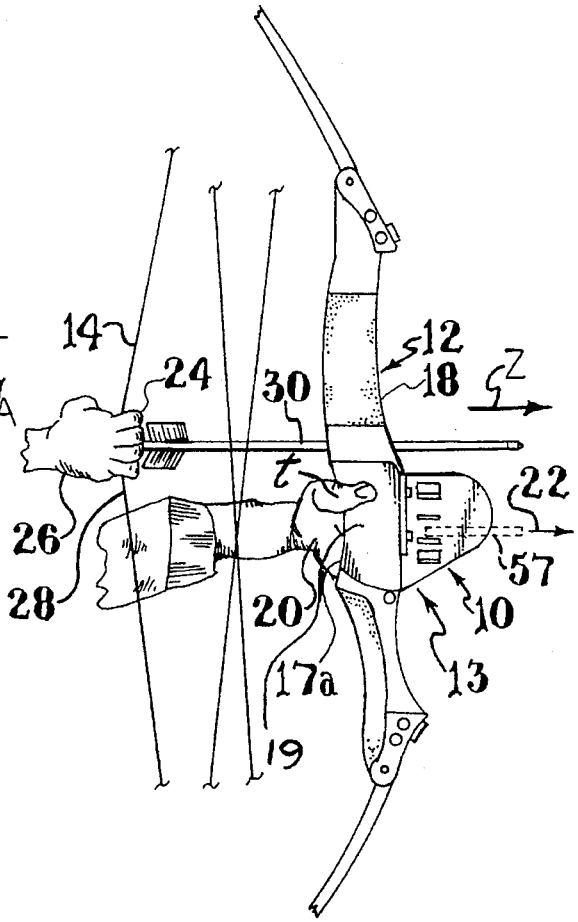
FIG. 2 is an opposite side elevational view thereof.
Figure 3:
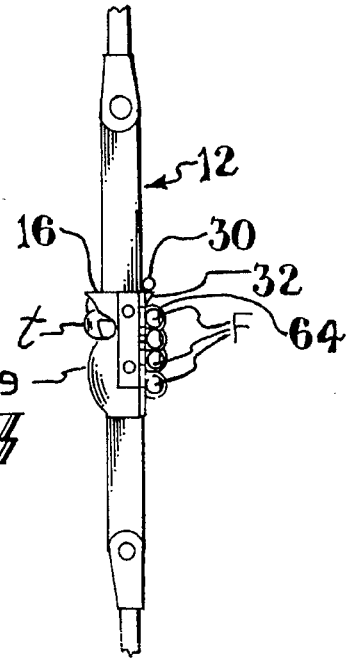
FIG. 3 is a front elevational view taken from the left side of FIG. 1.

The apparatus constructed according to the present invention, generally designated 10, is particularly adapted for use with a curved archery bow, generally designated 12, mounting a bow string, generally designated 14, between opposite, rearwardly disposed bow ends 15. The bow 12 generally comprises a flexible strip 11 having a forward mid-portion 13 provided with a rearward belly face 17*a* and an outside front face 18. The mid-portion 13 includes a hand grip 19 having the rear face 17*a* against which the archer's front bow holding hand 20 rests and pushes forwardly, in the direction of the arrow 22, when the bow is to be drawn as the fingers 24 of the rear archer's hand 26 rearwardly draw the mid-portion 28 of the bow string 14 to propel a straight, linear arrow 30 supported on an arrow rest 32, in a forward longitudinal path represented by the arrow Z (FIG. 1A). The rear end of the arrow 30 has fletching 31 and a string receiving noch (not shown) as usual. The arrow 30 lies in a vertical plane P.

When the string 14 is released to propel an arrow 30, the bow will tend to turn about the vertical axis a of the bow 12 in the direction of the arrow Y (FIG. 1*a*) transverse of the open palm of the bow hand 20. If the arrow rest 32 is located on the opposite side of the bow 12, the bow, upon arrow release, will tend to rotate in the direction of arrow X about the vertical bow axis a The archery aid, generally designated 10, will resist the tendency of the bow to turn about the axis a in the direction of the arrows X or Y.

Figure 5:
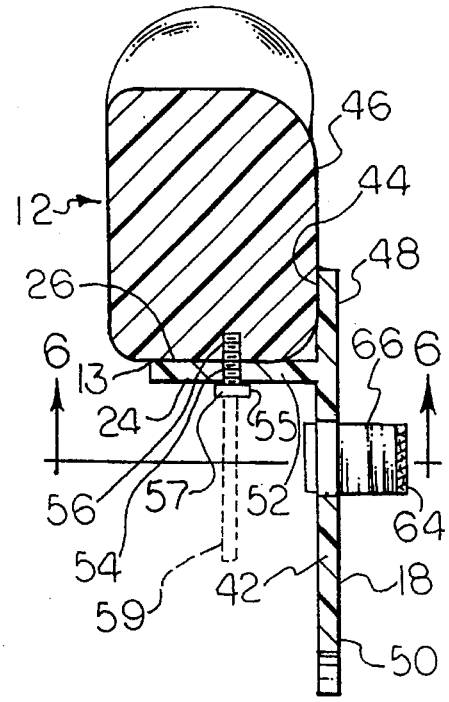
FIG. 5 is a top plan sectional view, taken along the line 5—5 of FIG. 4.

The archery aid 10, constructed according to the present invention, includes a vertical plate, generally designated 42, having a lateral side face 44 for bearing against one lateral side 46 of the bow and an opposite lateral face 48 against which the insides 50 of the fingers F of the front bow hand 20 bear. The surface 48 is parallel to the plane P of the arrow 30. The plate 42 may comprise suitable material such as metal or plastic. An integral, transverse mounting flange 52 is fixed to the inside plate surface 44 and bears against the front edge or bow face 18. The flange 52 is coupled to the face 18 via a screw 54 or a bolt which is threadedly received in a threaded opening 56. The threaded screw or bolts are threaded into openings 56 which are typically provided on a bow for mounting a stabilizer. If desired, the head 57 of one of the bolts 54 may be internally threaded at 55 for remounting a stabilizer bar schematically designated in chain lines at 59 in FIG. 5. As illustrated, the plate 42 is parallel to the plane P of the arrow whereby the fingers F lie in a plane which is also parallel to the plane P.

Mechanism, generally designated 60, is provided for holding the fingers F against the plate 42 to support the bow and includes a band, generally designated 64, weaved through a plurality of vertically spaced openings 62 in the plate 42. As illustrated, the band receiving openings include a plurality of vertically spaced pairs of closely adjacent apertures 62. The apertures 62 in each pair p are spaced a predetermined distance apart but each pair p is spaced a greater predetermined distance 50*a* from each adjacent pair p of apertures 62.

The finger receiving band, generally designated 64, is laced or intertwined in opposite directions through the adjacent ones of the openings 62 to provide a plurality of vertically spaced finger receiving apertures 66 for receiving the fingers F of the shooter's bow holding hand 20. A stop 68 is fixed to the lower end 70 of the band 64. The upper terminal end 72 of the band 64 is adjustably coupled to the lateral surface 44 of the plate 42 via hook and loop fastener 76, comprising a layer of material sold under the trademark "VELCRO," which is detachably coupled to a similar hook and loop fasteners layer 78 fixed to the inside surface 44 of plate 42.

THE OPERATION

Figure 1A:
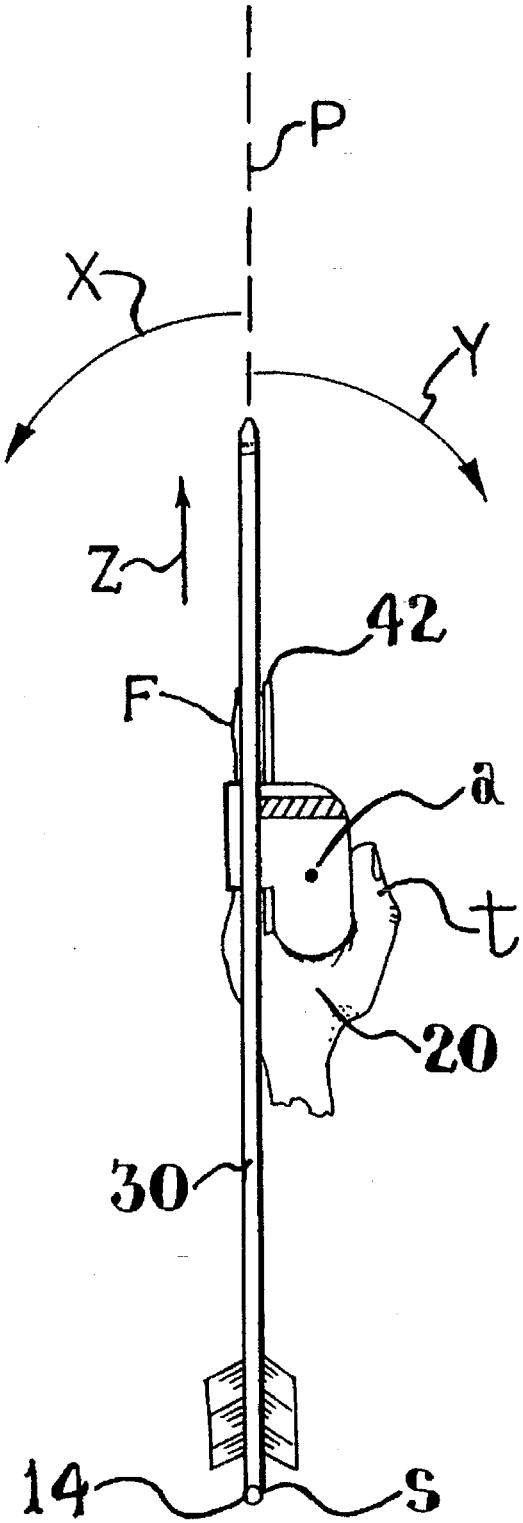
FIG. 1A is a top plan sectional view thereof, taken along the line 1A–1A of FIG. 1.
Figure 4:
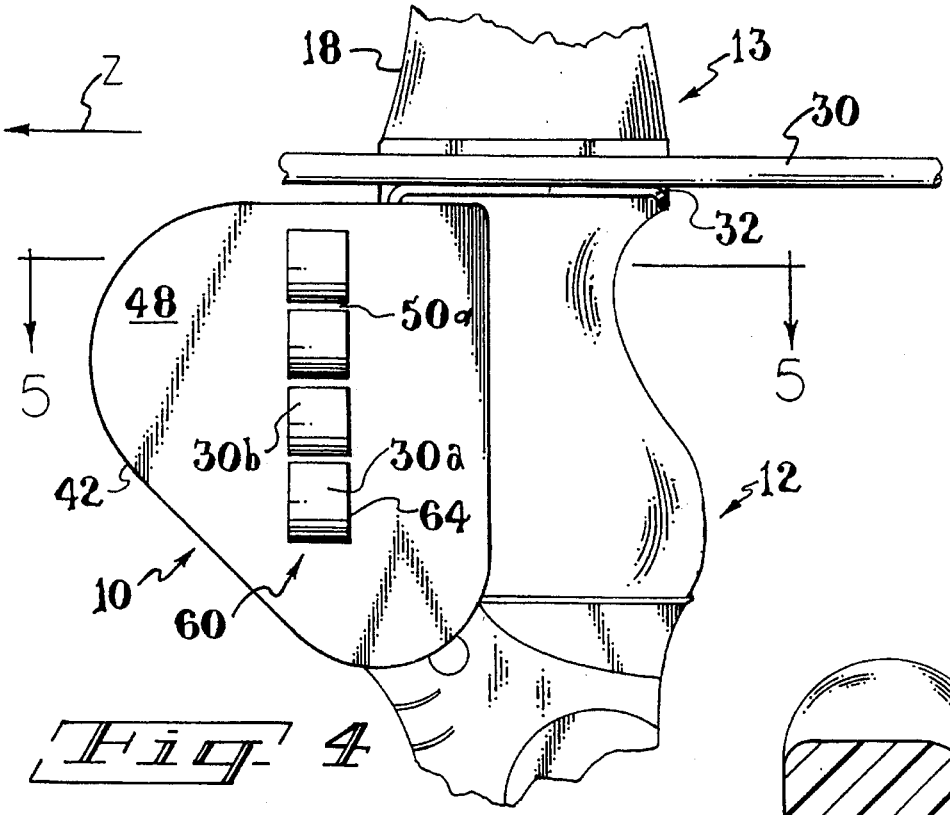
FIG. 4 is an enlarged side elevational view of the bow mid-portion only more particularly illustrating the archery aid constructed according to the present invention.

The archery aid 10 is bolted to the front face 18 of the hand grip 17, as illustrated in FIGS. 1–6. The band 64 is adjusted to adjust the size of the finger openings 66 so as to snuggly receive the fingers F of the shooters forward hand 20. The archer then inserts his fingers F into the openings 66 as illustrated in FIG. 1 on one lateral side 46 of the bow while his thumb T extends along the opposite lateral side of the bow. If desired, the strap 64 can be adjusted after the fingers F are inserted into the openings 66. The archer forwardly pushes the palm of the forward bow hand 20 against the belly surface 17 of the bow 12 while concurrently rearwardly drawing the bow string 14 and the arrow 30 resting on bow rest 32 to full draw position. The archer then relaxes the finger 24 of the string hand 26 to suddenly release the bow string 14.

As the bow string 14 is suddenly released, it will forwardly propel the arrow 30 in the direction of the arrow Z. As illustrated in FIG. 1A, the plane of the plate 42, and thus the plane of the surface 48 and the plane in which the fingers F lie, is parallel to the plane P in which arrow 30 lies and is also parallel to the direction Z in which the arrow 30 is propelled. The plate 42 comprises a stop which interferes with the movement of the fingers F towards the front bow surface 18 and thus precludes the archer from gripping the bow which would otherwise interfere with shooting accuracy. The fingers F which are held against the plate 50 will exert force on the plate in a direction opposite to the direction of the rotation Y of the bow about the axis a.

Accordingly, the plate 10 will maintain the hand forward bow hand open and preclude it from gripping the bow and concurrently inhibit rotation of the bow about its vertical axis a.

ALTERNATE EMBODIMENTS

A slightly different archer's aid, generally designated 10*a*, is illustrated in FIG. 7 and is similar in many respects to that illustrated in FIGS., 1–6. Similar parts will be identified by similar reference characters followed by the letter a subscript.

The archery aid 10*a* primarily differs in that the band 64*a* does not extend through openings provided in the plate but rather is glued or otherwise suitably secured, at intervals 65, 67, 68, to the outside lateral surface 48*a*. The band provides finger opening 66*a* of a fixed size.

The archery aid illustrated in FIGS. 8 and 9 is similar in many respects to that illustrated in FIGS. 1–6 and similar parts will be identified with similar reference characters followed by the letter b subscript. Rather than a band 66, the archery aid 10*b* includes a finger receiving mitten 66*b* which can comprise fabric having a lateral band or edge E which is glued or otherwise secured at 80 to the face 48*b* of the plate 42*b*. The mitten 66*b* replaces the band 66 illustrated in FIGS. 1–6 and the band 64*a* illustrated in FIG. 7.

The archery aid 10*c* illustrated in FIG. 10 is similar in many respects to the device 10 illustrated in FIGS. 1–6 and similar parts will be identified by similar reference characters followed by the letter c subscript.

The archery aid 10*c* differs primarily in that the transverse mounting flange 52 is removed and the rear portion 82 of the plate 42*c* is coupled to the bow mid-portion 13 via threaded bolts 86 which are received in openings 88 provided in a plate 90 which is disposed on the opposite side of the bow mid-portion 13 and includes a curved outer surface 92. The bolts 86 are threaded into threaded openings 91 provided in the inside surface of rear plate portion 82.

The archery aid 10*d* illustrated in FIGS. 11–14 differs primarily in that a bow sling, generally designated 100, is mounted on the bow 12*d* for holding the user's wrist, schematically designated W, to the plate 42*d*. The aid 10*d* includes a thin belt 112 having bow a receiving end, generally designated 114, which is wrapped around the bow 12*d* and an opposite wrist receiving end 116 which is wrapped around the user's wrist, schematically designated W.

Figure 13:
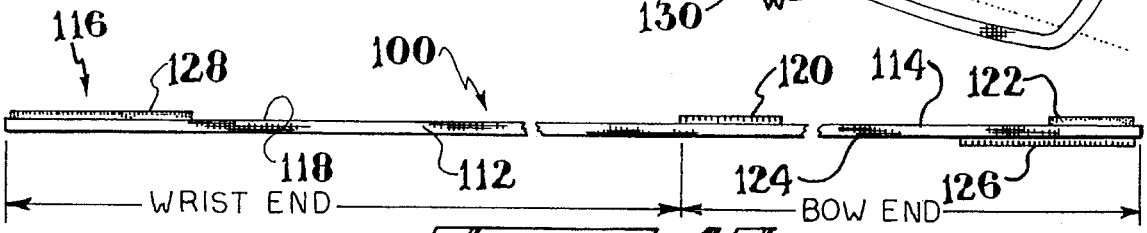
FIG. 13 is a top plan elevational view of an archery aid constructed according to the present invention incorporating a bow sling in a rolled out condition prior to installation on the bow as illustrated in FIGS. 11 and 12.
Figure 14:
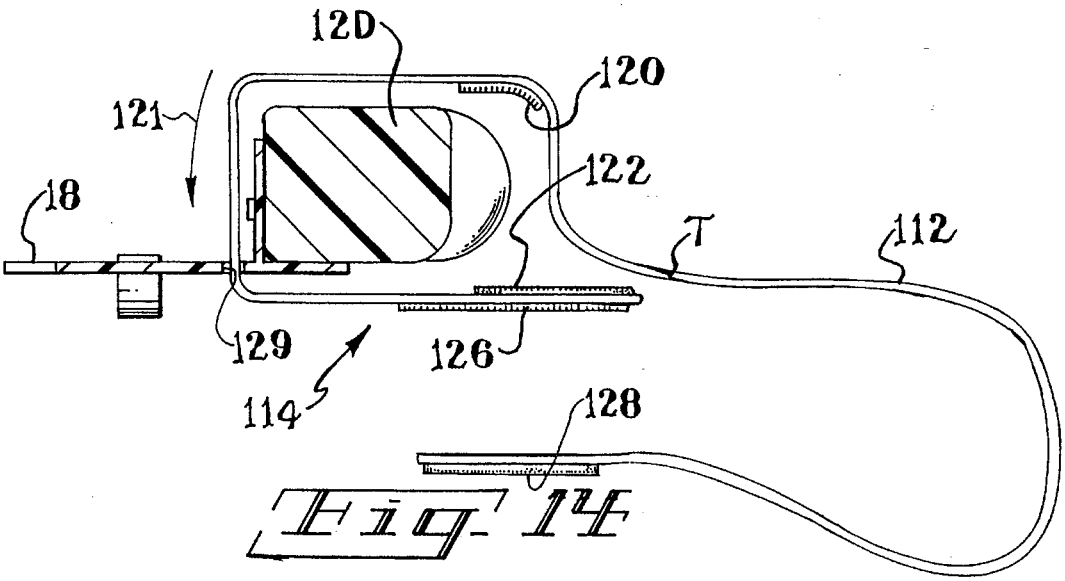
FIG. 14 is a top plan sectional view illustrating the initial step of installing the bow sling on a bow.

As illustrated in FIG. 13, one side or surface 118 of the wrist end of strap or belt 112 includes a hook and loop fastener 128 comprising a layer of material sold under the trademark VELCRO at the wrist receiving end 116 and at the bow receiving end 114, a shorter strip of hook and loop fastener material 122. Another small strip 120 of hook and loop fastener material is mounted on the surface 118 intermediate the ends 114 and 116, although closer to the hook and loop fastener strip 122 than to the hook and loop fastener strip 128.

The opposite side 124 of the bow receiving strip end 114 includes a strip or layer 126 of "velcro" material which is substantially longer than the "velcro" strip 122.

Figure 11:
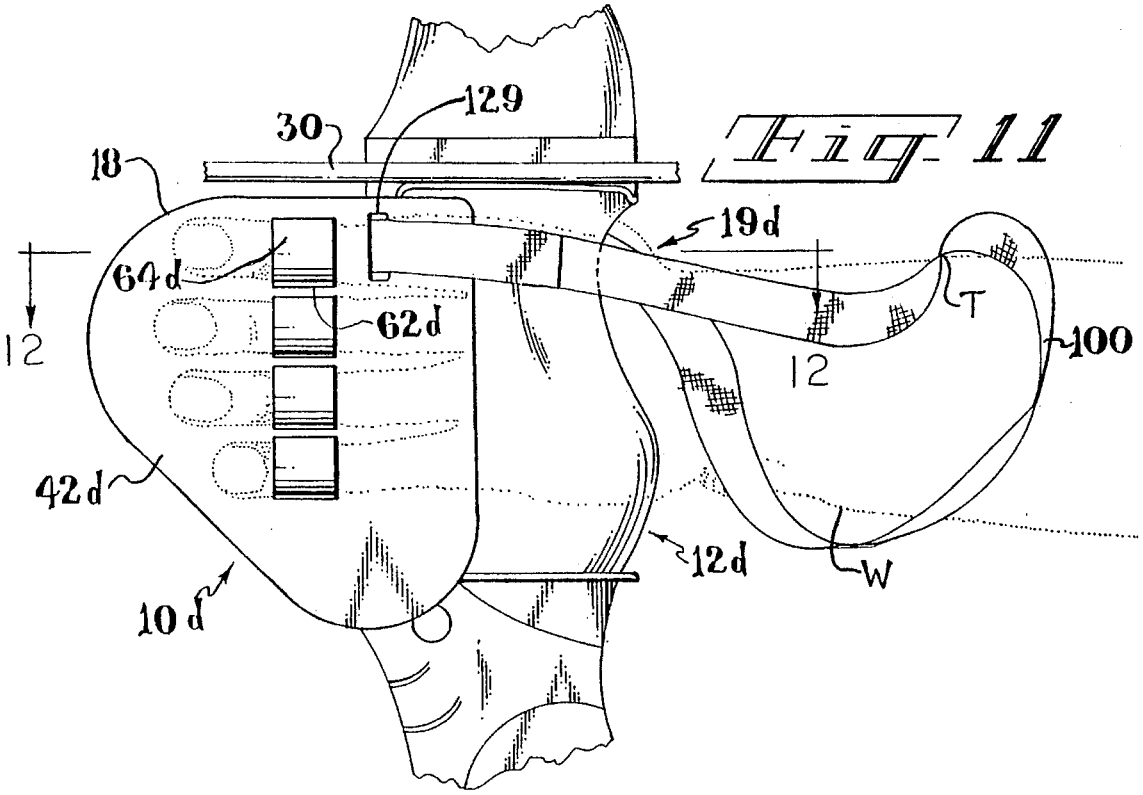
FIG. 11 is a side elevational view illustrating yet another slightly modified embodiment.
Figure 12:
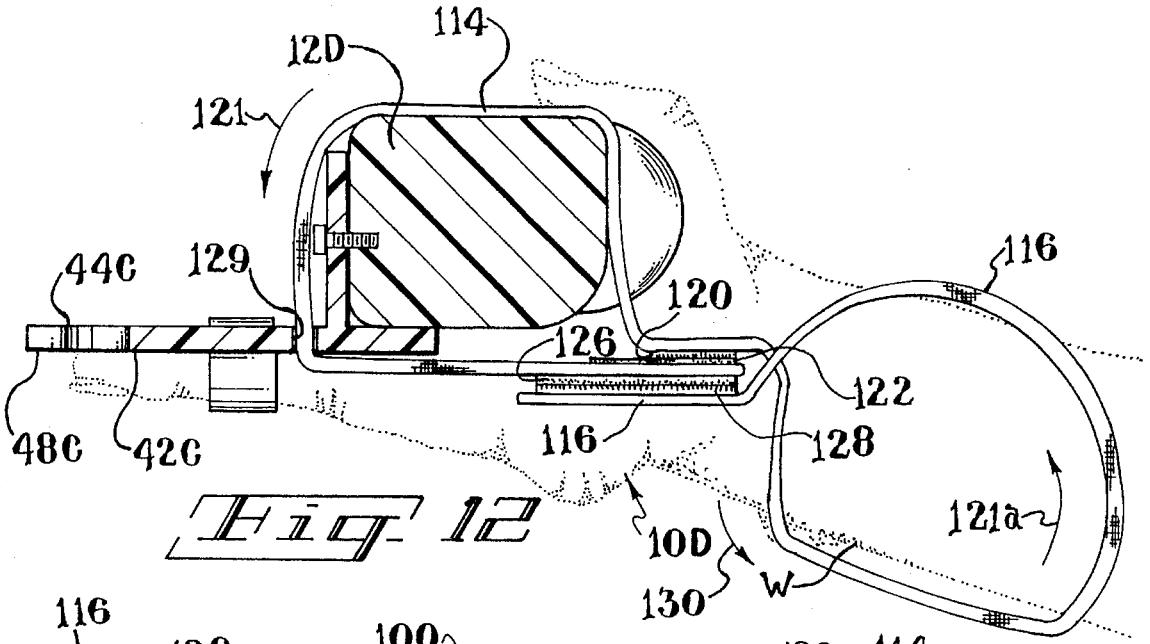
FIG. 12 is a top plan sectional view taken along the line 12—12 of FIG. 11.

As illustrated in FIGS. 11 and 12, the bow end 114 is wrapped around the bow hand grip 19*d* and is received in an opening 129, which is transverse to the openings 62*d*, in the plate 42*d* (See FIG. 11).

Before being installed on the bow handle 19*d*, the strap or belt 112 (FIG. 14) is twisted at T (FIG. 14) so that the bow end 114 is inverted relative to its position in FIG. 13 and the hook and loop fastener layers 128 and 126 are initially facing the same direction. The bow receiving end 114 is then wrapped around the bow handle 19*d*, in the direction of the arrow 121, and the velcro strip 122 is pressed into engagement with the hook and loop fastener strip 120 and the hook and loop fastener strip 128 remains temporarily exposed. The bow receiving loop end 114 is wrapped tight around the bow handle 19*d* as illustrated in FIG. 12.

The opposite wrist receiving sling end 116 is then snuggly wrapped around the shooter's wrist 10 in the opposite direction, represented by the arrow 121*a* (FIG. 12), and the layer 128 is placed into engagement with the hook and loop fastener strip 126 to inhibit the wrist W from moving laterally outwardly away from the bow handle 19*d* and the plate 42*d*, in the direction of the arrow 130.

Figure 6:
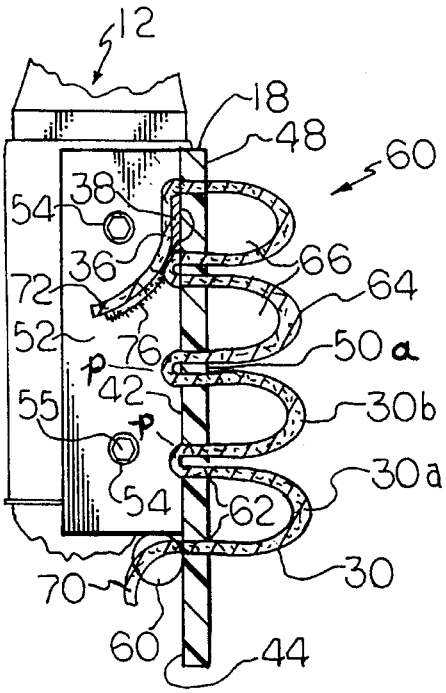
FIG. 6 is a front sectional view, taken along the line 6—6 of FIG. 5.
Figure 16:
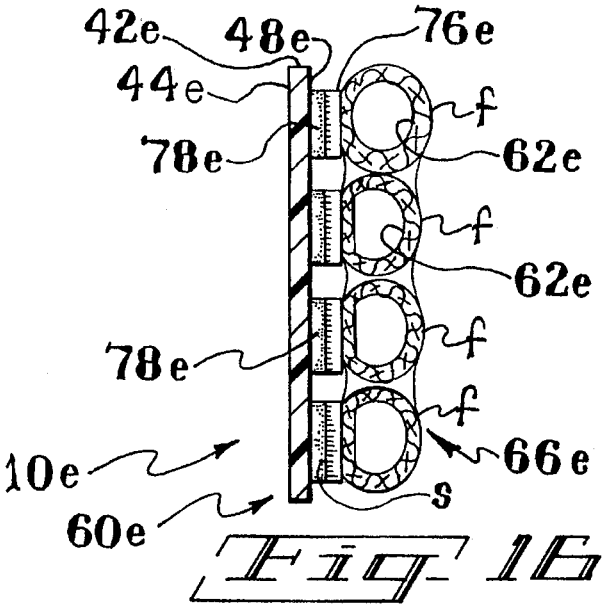
FIG. 16 is a front sectional view, taken along the line 16—16 of FIG. 15.
Figure 15:
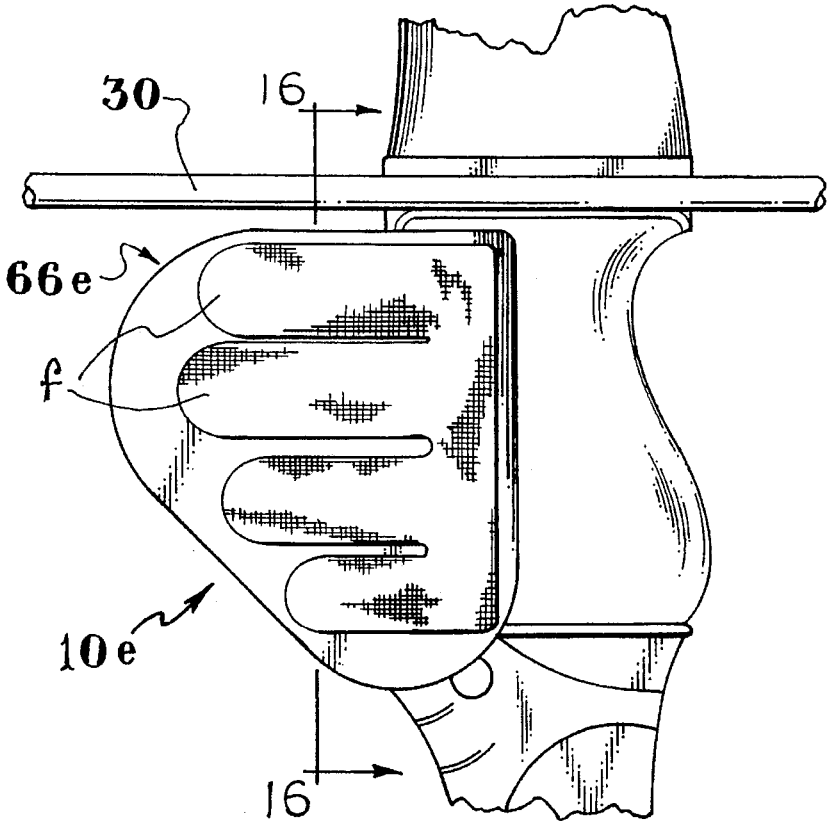
FIG. 15 is a side elevational view of a further slightly modified embodiment.

Referring now more particularly to FIGS. 15 and 16, another slightly modified archer's aid, generally designated 10*e*, is illustrated and is similar in many respects to that illustrated in FIG. 6. Similar parts will be identified by similar reference characters followed by the letter a subscript.

The archery aid 10*e* primarily differs in that rather than a band 66, the archer aid 10*e* includes a finger receiving glove, generally designated 66*e* having a plurality of finger portions f for receiving the fingers F of the shooter's bow holding hand. The fingers f define a plurality of vertically spaced openings 62*e* for receiving the fingers F of the shooter's hand as usual.

Apparatus, generally designated 60*e*, is provided for detachably holding the glove fingers f against the surface 48*e* of the plate 42*e* and includes a plurality of layers 76*e* of Velcro glued or otherwise fixed to the inside surfaces s of each of the glove fingers f and a plurality of complimentally formed and aligned velcro strips 78*e* fixed to the surface 48*e* in vertically spaced relation.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. An archery aid for a flexible curved archery bow including a flexible strip having opposite rear ends and a forward mid-portion between said ends provided with an inside rearward belly face and an outside forward face, and a rearwardly disposed, taut drawstring coupled between said ends and adapted to move said bow from a rest position to a flexed shooting position to propel an arrow in a predetermined forward path when an archer's first forward bow hand forwardly pushes against said belly face of said strip and an archer's second, rearward string hand concurrently rearwardly pulls the drawstring, said archery aid comprising:

means for holding the fingers of the first bow hand forwardly extended in a direction parallel to said predetermined forward path of the arrow to be propelled;

said means for holding the fingers extending forwardly of said outside forward face.

2. The archery aid set forth in claim 1 wherein said means for holding the fingers comprises plate means for bearing against the insides of the fingers of said bow hand.

3. An archery aid for a flexible curved archery bow including a flexible strip having opposite rear ends and a forward mid-portion between said ends provided with an inside rearward belly face and an outside forward face, and a rearwardly disposed, taut drawstring coupled between said ends and adapted to move said bow from a rest position to a flexed shooting position to propel an arrow in a predetermined forward path when an archer's first forward bow hand forwardly pushes against said belly face of said strip and an archer's second, rearward string hand concurrently rearwardly pulls the drawstring, said archery aid comprising:

means for holding the fingers of the first bow hand forwardly extended in a direction parallel to said predetermined forward path of the arrow to be propelled;

said means for holding the fingers comprising plate means for bearing against the insides of the fingers of said bow hand; and means on said plate means for receiving and detachably holding said fingers to said plate means.

4. The archery aid set forth in claim 3 wherein said means for receiving and holding said fingers comprises band means defining finger receiving openings.

5. The archery aid set forth in claim 4 wherein band means includes means for adjusting the size of said finger receiving openings.

6. An archery aid for a flexible curved archery bow including a flexible strip having opposite rear ends and a forward mid-portion between said ends provided with an inside rearward belly face and an outside forward face, and a rearwardly disposed, taut drawstring coupled between said ends and adapted to move said bow from a rest position to a flexed shooting position to propel an arrow in a predetermined forward path when an archer's first forward bow hand forwardly pushes against said belly face of said strip and an archer's second, rearward string hand concurrently rearwardly pulls the bowstring, said archery aid comprising:

means for holding the fingers of the first bow hand forwardly extended in a direction parallel to said predetermined forward path of the arrow to be propelled;

said means for holding the fingers comprising plate means for bearing against the insides of the fingers of said bow hand; and means for detachably holding said fingers to said plate means comprising:

glove means for receiving said fingers;

first and second cooperating coupling members on said plate means and said glove means for detachably coupling said glove means to said plate means.

7. The archery aid set forth in claim 6, wherein said first cooperating means comprises a layer of hook and loop fastener material on said plate means and said second cooperating means comprises a layer of hook and loop fastener material on said glove means.

8. An archery aid for a flexible curved archery bow including a flexible strip having opposite rear ends and a forward mid-portion between said ends provided with an inside rearward belly face and an outside forward face, and a rearwardly disposed, taut drawstring coupled between said ends and adapted to move said bow from a rest position to a flexed shooting position to propel an arrow in a predetermined forward path when an archer's first forward bow hand forwardly pushes against said belly of said strip and an archer's second, rearward string hand concurrently rearwardly pulls the drawstring, said archery aid comprising:

means for holding the fingers of the first bow hand forwardly extended in a direction parallel to each other and parallel to said predetermined forward path of the arrow to be propelled; and means for stationarily mounting said aid on a bow in fixed relation to a bow.

9. An archery aid for an archery bow having a front outside surface, and a rear, inside surface against which the open palm of an archer's bow hand bears, said aid comprising:

means, adapted to be mounted on the bow in the path of the fingers of the archer's bow hand, for precluding said fingers from closing and gripping said outside surface of said bow;

said means for precluding said fingers from closing and gripping comprising plate means against which the insides of the fingers of said archer's bow hand abut extending forwardly of said front outside surface.

10. The archery aid set forth in claim 9 including means on said plate means for receiving and holding said fingers to said plate means.

11. The archery aid set forth in claim 9 wherein said means for receiving and holding said fingers to said plate means comprises glove means for receiving said fingers of said bow hand and first and second cooperating means on said plate means and said glove means for detachably holding said glove means and said fingers to said plate means.

12. The archery aid set forth in claim 9 including wrist holding means for holding the archer's bow wrist to said means for precluding said fingers from closing.

13. The archery aid set forth in claim 12 wherein said wrist holding means comprises strap means coupled to said plate means and including means for detachably receiving said wrist.

14. An archery aid for an archery bow having a from side an inner rear bow side having a mid-portion against which an archer's bow hand bears and opposite ends adapted to be spanned by a drawstring, said archery aid comprising:

stop means for mounting on, but adapted to extend forwardly of, said bow for precluding the fingers of an archer's bow holding hand from closing and gripping said front side of said bow.

15. The archery aid set forth in claim 14 wherein said stop means comprises a plate.

16. The archery aid set forth in claim 15 including means for receiving and holding said fingers to said plate.

17. The archery aid set forth in claim 16 including wrist holding means detachably coupled to said plate and detachably coupled to the archer's bow holding wrist for preventing said wrist from moving in a direction transverse to said plate.

18. The archery aid set forth in claim 16 wherein said means for receiving and holding comprises band means having a plurality of finger receiving openings therein.

19. The archery aid set forth in claim 18 wherein said band means is adjustable in length to adjust the size of said finger receiving openings.

20. The archery aid set forth in claim 19 wherein said plate includes a plurality of vertically spaced openings therethrough and said band means comprises a band wound through said openings.

21. An archery aid for an archery bow having a front side and a rear side, and opposite ends adapted to be spanned by a drawstring, said rear side including a mid-portion between said opposite ends against which an archer's bow hand bears, said aid comprising:

open hand maintaining means for maintaining open said archer's bow holding hand to preclude said bow holding hand from gripping said front side of said bow; and means for mounting said open hand maintaining means on said bow in such position that a portion of said open hand maintaining means extend forwardly of said front side of said bow.

22. The archery aid set forth in claim 21, wherein said open hand maintaining means comprises a plate having one lateral side for mounting on said bow and an opposite lateral side against which the fingers of said archer's bow holding hand bear.

23. The archery aid set forth in claim 22 including a wrist holding sling for detachably coupling the wrist of said archer's bow hand to said plate to prevent said wrist from transversely moving in a direction away from said plate.

24. The archery aid set forth in claim 21 including means on said plate for receiving and holding at least one of said fingers to said opposite lateral side of said plate.

25. The archery aid set forth in claim 21 wherein said open hand maintaining means comprises stop means in the path of the fingers of said bow holding hand and means for receiving and holding said fingers to said stop means.

26. An archery aid for an archer's bow having opposite ends spanned by a bow string and a hand grip portion between said opposite ends against which the palm of an archer's bow hand bears during bow string draw and release, said archery aid comprising:

plate means having one lateral side for mounting on said bow and an opposite lateral side for abutting the insides of the fingers of said archer's bow hand to preclude said fingers from closing and gripping said hand grip portion; and means for mounting said plate means on said bow adjacent said hand grip portion.

27. The archery aid set forth in claim 26 including means for receiving and holding at least one of said fingers to said plate means to hold said fingers in abutting relation with said opposite side of said plate means.

28. The archery aid set forth in claim 27 including wrist holding means coupled to said plate means for detachably coupling the wrist of said bow shooters hand to said opposite lateral side of said plate means and precludes movement of said wrist in a direction away from said opposite side.

29. An archery aid for an archery bow for propelling a linear arrow in a predetermined longitudinal path, said bow having from and rear sides and opposite ends adapted to be spanned by a rearwardly disposed, taut drawstring for receiving a rear portion of said arrow to be propelled;

said aid comprising:

open hand maintaining means extending forwardly of said from side of said bow for maintaining, in a plane parallel to a plane in which said arrow lies, the fingers of an archer's bow holding hand, which bears against said rear inside of said bow, to preclude said fingers from gripping said from side of said bow.

30. The archery aid set forth in claim 29 wherein said open hand maintaining means comprises stop means in the path of the fingers of said bow holding hand and including means for receiving and holding at least one of said fingers to said stop means.

31. In combination with an archer's bow having front and rear bow faces, opposite ends, and a mid-portion between said opposite ends, and a taut bowstring having opposite ends coupled to said opposite ends of said bow and a mid-portion rearward of said rear bow face on which a rear portion of a linear arrow to be propelled is received, an arrow rest mounted on said mid-portion of said bow, said rear bow face of said mid-portion including a hand rest portion adjacent said arrow rest for receiving the palm of one forward archer's hand for stabilizing the bow when the other rearward archer's hand rearwardly pulls said mid-portion if said bowstring relative to said bow;

means, including means extending forwardly of said front bow face, for precluding the fingers of said one forward archer's hand, from closing on said front bow face to prevent said forward archer's hand from gripping said bow mid-portion.

32. The combination set forth in claim 314 wherein said means extending forwardly includes means for receiving said fingers of said one forward archer's hand for vertically supporting said bow on said forward archer's hand.

33. The combination set forth in claim 32 wherein said means for receiving said fingers comprises band means for snugly receiving at least one finger on said forward archer's hand.

34. The combination set forth in claim 31 wherein said arrow lies in a predetermined plane; said means for precluding said fingers from closing comprises means extending generally parallel to said plane.

35. In combination with an archer's bow having from and rear bow faces, opposite ends, and a mid-portion between said opposite ends, and a taut bowstring having opposite ends coupled to said opposite ends of said bow and a mid-portion reward of said rear bow face on which a rear portion of a linear arrow to be propelled is received, an arrow rest mounted on said mid-portion of said bow, said arrow lying in a predetermined vertical plane; said rear bow face of said mid-portion including a hand rest portion adjacent said arrow rest for receiving the palm of one forward archer's hand for stabilizing the bow when the other rearward archer's hand rearwardly pulls said mid-portion of said bowstring relative to said bow;

means extending generally parallel to said vertical plane for precluding the fingers of said one forward archer's hand, from closing on said front bow face to prevent said forward archer's hand from gripping said bow mid-portion.

36. In combination with an archer's bow having front and rear bow faces, opposite ends, and a mid-portion between said opposite ends, and a taut bowstring having opposite ends coupled to said opposite ends of said bow and a mid-portion rearward of said rear bow face on which a rear portion of a linear arrow to be propelled is received, an arrow rest mounted on said mid-portion of said bow, said rear bow face of said mid-portion including a hand rest portion adjacent said arrow rest for receiving the palm of one forward archer's hand for stabilizing the bow when the other rearward archer's hand rearwardly pulls said mid-portion if said bowstring relative to said bow;

means for precluding the fingers of said one forward archer's hand, from closing on said from bow face to prevent said forward archer's hand from gripping said bow mid-portion;

said means for precluding said fingers from closing comprising plate means extending forwardly of said front face of said bow mid-portion.

37. The combination set forth in claim 36 including band means on said plate means for receiving said fingers on said forward shooter's hand to vertically support said bow when said arrow is released.

38. The combination set forth in claim 37 wherein said plate means includes a plurality of vertically spaced apertures therethrough, and said band means includes a strap threaded through said apertures to provide a plurality of vertically spaced finger receiving finger holes on said plate means.

39. The combination set forth in claim 38 including cooperating means on said plate means and said strap for adjusting the effective length of said strap and the size of said finger holes.

40. The combination set forth in claim 39 wherein said cooperating means includes detachable fasteners on said strap and said plate means.

41. In combination with an archer's bow having front and rear bow faces, opposite ends, and a mid-portion between said opposite ends, and a taut bowstring having opposite ends coupled to said opposite ends of said bow and a mid-portion rearward of said rear bow face on which a rear portion of a linear arrow to be propelled is received, an arrow rest mounted on said mid-portion of said bow, said rear bow face of said mid-portion including a hand rest portion adjacent said arrow rest for receiving the palm of one forward archer's hand for stabilizing the bow when the other rearward archer's hand rearwardly pulls said mid-portion if said bowstring relative to said bow;

means for precluding the fingers of said one forward archer's hand, from closing on said front bow face to prevent said forward archer's hand from gripping said bow mid-portion;

said means for precluding the fingers from closing comprising a plate mounted on said bow mid-portion and extending forwardly of said mid-portion.

42. The combination set forth in claim 41 including finger receiving means for receiving and holding the fingers of said one forward archer's hand to said plate.

43. The combination set forth in claim 42 wherein said finger receiving means comprises glove means for receiving said fingers of said one forward archer's hand and first and second cooperating holding members on said plate and said glove means respectively, for detachably holding said glove to said plate.

44. The combination set forth in claim 41 including wrist holding means coupled to said plate for detachably holding the wrist of said archer's hand to preclude said wrist from moving in a direction away from said plate.

45. An archery aid for a flexible curved archery bow comprising a flexible bow strip having opposite rear ends, a longitudinal axis extending through said strip between said ends, and a forward mid-portion provided with
an inside rear belly,
an outside forward face; and a taut bowstring coupled between said ends and adapted to move said bow from a rest position to a flexed shooting position to forwardly propel an arrow when an archer's front bow hand forwardly pushes against said belly of said strip and an archer's rear string hand concurrently rearwardly pulls the bowstring;

said archery aid comprising:

open hand maintaining means for bearing against the fingers of said bow hand forwardly of said outside forward face and inhibiting said flexible strip from rotating in a direction about said longitudinal axis when said bowstring is released to propel an arrow.

46. The archery aid set forth in claim 45 including means for detachably receiving and holding at least one finger of the bow holding hand.

47. The archery aid set forth in claim 46 wherein said open hand maintaining means includes a plate mounted on said mid-portion and extending forwardly of said forward face and including means for receiving and holding at least one finger of said bow hand to said plate.

48. An archery aid for a curved archery bow having a front outside surface and a rear inside surface against which the palm of an archer's bow hand bears, and on laterally opposite sides of surfaces extending between said front outside surface and said rear inside surface said archery aid comprising:

a plate having a front portion and a rear portion;

means for mounting said rear portion of plate on one of said laterally opposite side surfaces of said bow between said front and rear surfaces such that said front portion of said plate is disposed forwardly of said front outside surface; and finger receiving means mounted on said plate for detachably securing a portion of the archer's bow hand to the plate.

49. The archery aid set forth in claim 48 wherein said plate includes a plurality of pairs of vertically spaced apertures through said plate, said apertures in each of said pairs of apertures being spaced apart a predetermined distance, each of said pairs of apertures being spaced from each adjacent pairs of apertures by a greater predetermined distance.

50. The archery aid set forth in claim 48 wherein said means for detachably securing comprises a glove for receiving a portion of said archer's bow hand and first and second cooperating attaching means on said plate and said glove for detachably, respectively, securing said glove to said plate.

51. An archery aid for mounting on an archer's bow adapted to be held in an archer's bow holding hand to forwardly propel an arrow comprising:

stop means for mounting on, but adapted to extend forwardly of, an archer's bow for precluding an archer's bow holding hand from closing and gripping said bow; and mean for mounting said top means on an archer's bow.

* * * * *